United States Patent [19]

Kvaerna et al.

[11] 4,061,324

[45] Dec. 6, 1977

[54] PATIENTS SUPPORT TABLE

[75] Inventors: Sverre Kvaerna, Farsta; Sigvard Barud, Jarfalla, both of Sweden

[73] Assignee: Siemens Aktiengesellschaft, Berlin & Munich, Germany

[21] Appl. No.: 661,514

[22] Filed: Feb. 26, 1976

[30] Foreign Application Priority Data

Mar. 3, 1975 Germany ..... 2509104

[51] Int. Cl.[2] ..... A61G 13/00

[52] U.S. Cl. ..... 269/325

[58] Field of Search ..... 269/322-328; 5/68

[56] References Cited

U.S. PATENT DOCUMENTS

| | | | |
|---|---|---|---|
| 3,428,307 | 2/1969 | Hunter et al. | 269/322 |
| 3,633,901 | 1/1972 | Lindquist | 269/323 |
| 3,742,527 | 7/1973 | Johnston et al. | 5/68 |
| 3,798,684 | 3/1974 | Benoit et al. | 5/68 |
| 3,845,946 | 11/1974 | Warden et al. | 269/323 |

*Primary Examiner*—Robert C. Watson

*Attorney, Agent, or Firm*—Hill, Gross, Simpson, Van Santen, Steadman, Chiara & Simpson

[57] ABSTRACT

A patients support table which is displaceable in two directions. In the inventive arrangement, when a patients support arrangement of the table is removable from a pedestal and drive motors are located therein, there are provided compressed air couplings between the pedestal and the patients support arrangement. In the event of minor sealing leaks of these couplings, some compressed air will escape into the atmosphere which is not of any significance.

3 Claims, 3 Drawing Figures

PATIENTS SUPPORT TABLE

FIELD OF THE INVENTION

The present invention relates to a patients support table.

DISCUSSION OF THE PRIOR ART

A patients support table is described in U.S. Pat. No. 3,845,946, and includes a patients support arrangement which is displaceable with reference to a pedestal in at least one direction through the intermediary of at least one pressure medium motor, with the motor having a pressure medium conduit incorporating at least one controllable valve, and wherein all of the control conduits of all of the valves lead to a common control device which possesses manually actuatable control elements for the valves. In this known patients support table the displacement of the patients support arrangement is effectuated through a hydraulic displacement installation whose valves are located within a pneumatic control circuit. During the displacement and control of the known patients support table no kinds of electrical sparks will occur, since electrical components are completely omitted in the displacement and control installation. Accordingly, in the utilization of the patients support arrangement in an operating chamber there is obviated the danger of explosion, the latter of which is present in the employment of electrical displacement and control means as a result of the unavoidable formation of sparks in conjunction with the anesthetic gas.

However, in the known patients support arrangement the complicated construction thereof is disadvantageous. Employed for the drive of the pressure generator for the hydraulic system is an air pressure motor, which is driven by the compressed air of the control system. Consequently, there is a need for the presence of a compressed air source and, in addition thereto, a motor for generating the pressure in the hydraulic system. Furthermore, it is particularly disadvantageous, when the patients support arrangement is removable from the pedestal and the drive motors are located in the patient support arrangement, that there must be present hydraulic couplings between the pedestal and the removable patient support arrangement. In those types of couplings the escape of oil cannot be completely avoided, so as to cause fouling.

SUMMARY OF THE INVENTION

Accordingly, it is an object of the present invention to provide a patients support table of the above-mentioned type which is simplified in its construction in comparison with the state of the art, and which is also improved with respect to its susceptibility to trouble.

The foregoing object is inventively attained in a patients support table in which the motor is a compressed air motor. In the inventive arrangement, when the patients support arrangement is removable from the pedestal and the drive motors are located therein, there are provided compressed air couplings between the pedestal and the patients support arrangement. In the event of minor sealing leaks of these couplings, some compressed air will escape into the atmosphere, which is not of any significance.

A particularly advantageous embodiment of the invention is provided when the valves for the motor control comprise compressed air-controllable valves, and the control elements of the control device are manually actuatable air valves. In this embodiment it is sufficient to employ a single compressed air source for the drive means for the air motors, as well as for also the control medium. Hereby, it is possible that the drive motors may be driven with a compressed air whose pressure is higher than the pressure of the control air.

A pressure reduction may hereby be carried out, when employing a single compressed air source, for generating the control air through the intermediary of a reduction valve. A suitable embodiment of the coupling between the pedestal and patients support arrangement, when the patients support arrangement is removable, is provided for when all motors for the movement of the patients support arrangement are located in an upper portion of the table which is removably connected with the pedestal, and in wherein a coupling is provided between the upper portion of the table and the pedestal which releases the compressed air flow between the pedestal and the upper portion upon mounting of the upper portion, and which closes off the compressed air conduits of the pedestal upon removal of the upper portion. Another feature of the invention facilitates that the patients support arrangement may be displaced at two different speeds.

BRIEF DESCRIPTION OF THE DRAWINGS

Further details and advantages of the invention may now be ascertained from the following description of the exemplary embodiment thereof, taken in conjunction with the accompanying drawings; in which.

DETAILED DESCRIPTION

Figure 1:
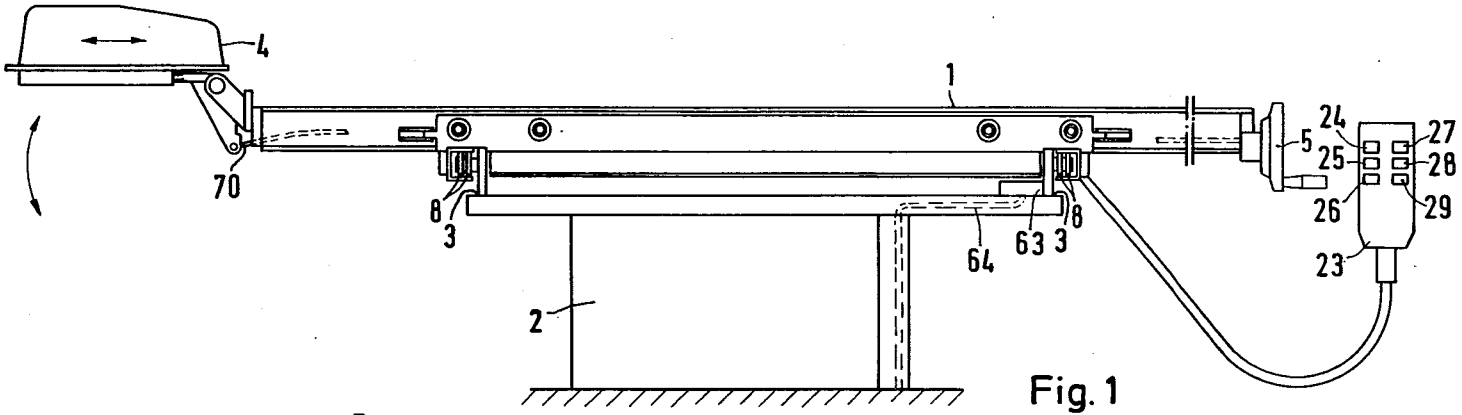
FIG. 1 illustrates a side elevational view of a patients support table constructed pursuant to the invention.
Figure 2:
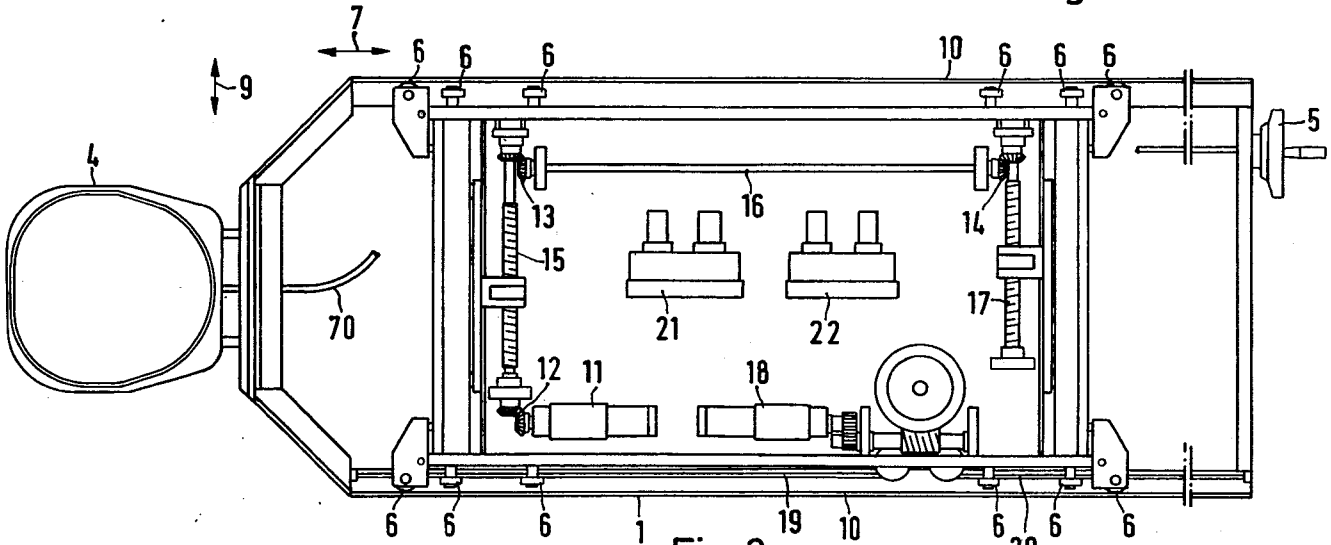
FIG. 2 is a top plan view of the patients support table of FIG. 1 with the upper table plate having been removed for purposes of illustration.

The patients support table illustrated in FIGS. 1 and 2 of the drawings possesses a patients support arrangement 1, the latter of which is removably supported on a pedestal 2. The separation between components 1 and 2 is effected at the locations 3. The patients support arrangement 1 possesses a head support 4 which is manually displaceable through manipulation of a crank 5. The crank 5 is effective on a cable line 70. Further, the patients support arrangement 1 possesses rollers 6 which permit the upper portion of the former, supporting a table plate (not shown), to be displaced in a longitudinal direction, meaning along the direction of the double-headed arrow 7. The table plate has been shown removed for purposes of clarity so as to, in FIG. 2, render visible the displacing means for the patients support arrangement. Additionally located on the patients support arrangement 1 are rollers 8 which run in rails and permit for a displacement of the patients support arrangement in a horizontal plane perpendicular to its longitudinal direction, meaning along the direction of the double-headed arrow 9. The rollers 6, which are guided in rails 10, together with these rails, and with the rollers 8 and the rails associated therewith form a cross slide.

For effecting the movement of the patients support arrangement along the direction of the double-headed arrow 9, located therein is a compressed air motor 11 which drives the drive means for the patients support arrangement through intermediary of drives or bevel gears 12 through 14 and shafts 15 through 17. For effecting the displacement of the patients support arrangement along the direction of the double-headed arrow 7 there is provided therein a compressed air motor 18 which drives the patients support arrangement through the chain pulls 19 and 20.

The control of the compressed air flow to the motors 11 and 18 is carried out through control valves 21 and 22 which, together with further control valves not shown in FIG. 2, are located in a compressed air control circuit. This compressed air control circuit contains a control device 23 with push buttons 24 through 29 for effecting control over the table displacement.

Figure 3:
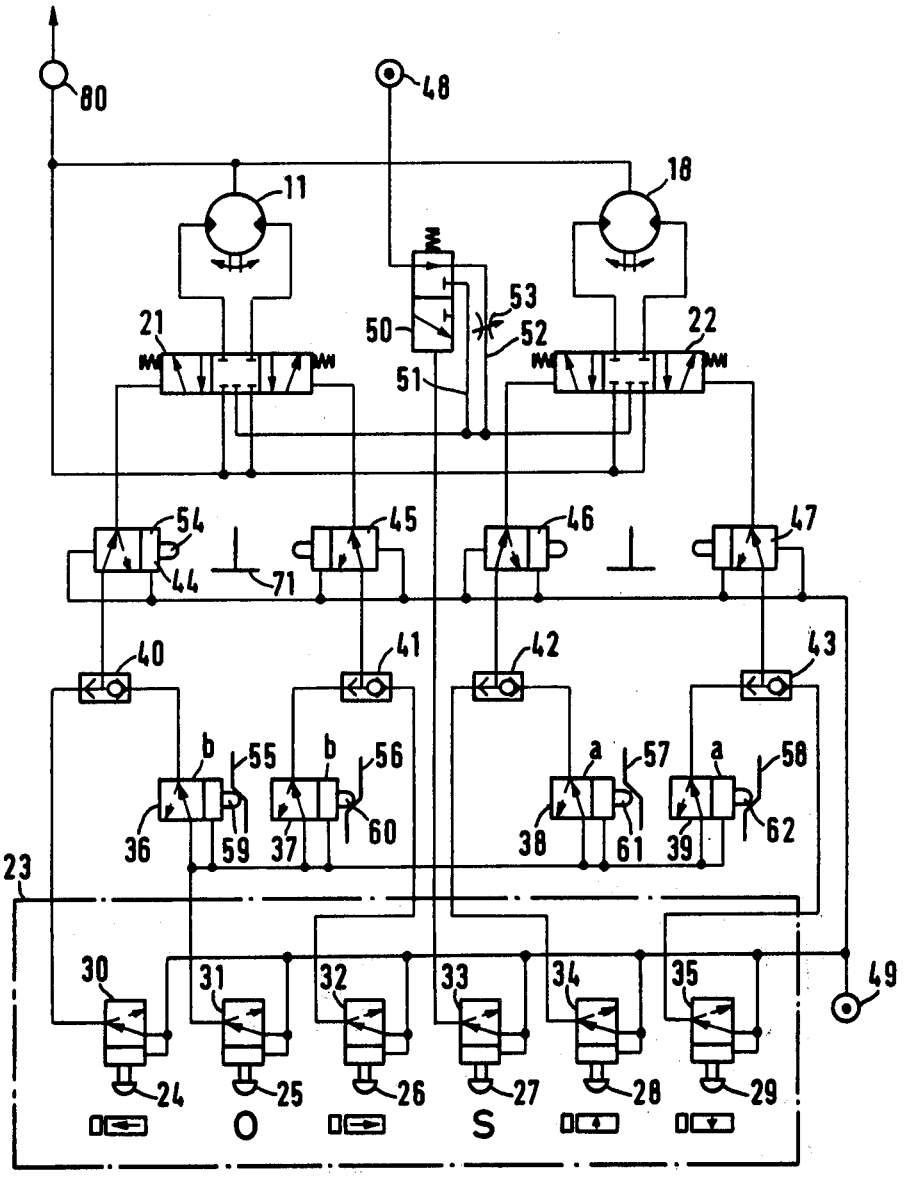
FIG. 3 is a block circuit diagram of the pneumatic control and displacement installation for the patients support table of FIGS. 1 and 2.

Referring now to FIG. 3 of the drawings, hereinbelow there is more closely detailed the pneumatic displacement and control circuit. FIG. 3 illustrates, within the phantom-line drawn box 23, the push bottons 24 through 29, of which the push buttons 24 and 26 serve for the control of a table displacement along the direction of the double-headed arrow 7, the push buttons 28 and 29 for the control of a table displacement along the direction of the double-headed arrow 9, the push button 25 actuation of the automatic reconveyance of the table into its initial position, and the push putton 27 for the selection of the speed of displacement. Control valves 30 through 35 are associated with the push buttons 24 through 29, and are located in a control circuit for the valves 21 and 22 which, for determining the initial position, incorporates four positioning valves 36 through 39, four two-way valves 40 through 43, and four limit valves 44 through 47. The compressed air motors 11 and 18 are schematically indicated in FIG. 3 of the drawings. The drive air is supplied at the coupling location 48 and the control air at the coupling location 49. For instance, the pressure of the drive air may be 60 $N/cm^2$ and the pressure of the control air 14 $N/cm^2$. The control circuit also contains a control valve 50 which allows the drive air of the motors 11 and 18 is supplied either directly through the conduit 51 or through a throttle valve 53 which is interposed in the conduit 52.

Thus, for example, should the patients support arrangement 1 be displaced towards the left across the pedestal 2, then there is actuated the push botton 24, which allows the control air to pass across the two-way valve 40 and the limit valve 44 to the control valve 21, and which permits the drive air to flow in such a direction through the compressed air motor 11 whereby the patients support arrangement 1 effects the desired displacing movement. When there is reached the end position of the patients support arrangement, a cam 71 will then push against the actuating element 54 of the limit valve 44 and interrupts the control air flow to the control valve 21, so that the latter inactivates the motor 11.

In a similar manner is effected the switching on of one of the motors 11 and 18 upon actuation of one of the push bottons 26, 28 and 29, and a deactivation of the presently switched in motor upon actuation of one of the limit switches 45 through 47.

In the illustrated position of the valve 50, the drive air flows to the currently switched on drive motor through the throttle valve 53 so as to result in a movement of the patients support arrangement at a normal speed. Should this speed be raised, meaning that a rapid displacement is desired, then there is actuated the push button 27, whereby the valve 50 is pneumatically switched into a position in which the drive air bypasses the throttle valve 53 and flows through the conduit 51 directly to the currently switched in drive motor.

Should an initial position be reached from a predetermined position, then there is actuated the push button 25 which connects all positioning valves 36 through 39 to the control air source. The positioning valves 36 through 39 release the control air flow to the control valves 21 and 22 through the two-way valves 40 to 43 and the limit valves 44 through 47, so that the motors 11 and 18 are concurrently so activated that the patients support arrangement is conveyed into its initial position. In this initial position, the cam 55 through 58, which are connected with the displaceable portions of the patients support arrangement, slide onto the actuating elements 59 through 62 of the positioning valves 36 through 39, and actuate these valves. Thereby, the patients support arrangement is rendered stationary in the initial position thereof.

Within the scope of the invention it is also possible that the cams 55 through 58 be made adjustable, so as to make it possible to carry out an adjustment of the initial position.

In the above-described patients support arrangement no electrical components are required for the displacement or for the control of the displacement. The displacement and the control of the displacement are carried out by means of the same medium, namely compressed air, so that the construction of the displacement and control circuits become extremely simple. Furthermore, within the scope of the invention it is possible that there be employed a single compressed air source for supplying the displacement motors 11 and 18 and the control circuit when a reduction valve is connected intermediate the compressed air source and the coupling location 49, but with the compressed air source being directly connected on the other side to the coupling location 48. Within the scope of the invention, it is also possible that there be provided between the compressed air source and each of the coupling locations 48 and 49 a respective reduction valve, and to adjust the currently desired pressure at these reduction valves, respectively, to correspondingly dimension these reduction valves.

Arranged on the pedestal 2 is a compressed air coupling device 63 to which there leads the phantom-illustrated and schematically drawn compressed air conduit 64. Upon mounting of the patients support arrangement 1 on the pedestal 2, the compressed air flow is automatically released across the coupling arrangement 63 to the components in the patients support arrangement 1, in effect, the motors 11 and 18 and the control valves. When the patients support arrangement 1 is removed, the compressed air conduit 64 are then automatically closed off so as to prevent compressed air from streaming out.

For displacement and for the control circuit there may be utilized the compressed air which is present in any operating chamber, meaning a compressed air source which is centrally located within a hospital. The patients support table 1, 2 can be connected to this compressed air source by means of conduit 64.

The head support 4 yieldable connected with the patients support arrangement 1 in such a manner that no dangerous pressure or pull is imparted to the neck of the patient during and after the displacement. When the force exerted on the neck of the patient exceeds a predetermined value, then the head support 4 will also yield so as to render it harmless.

In the described exemplary embodiment, the compressed air escapes to atmosphere at location 80.

While there has been shown what is considered to be the preferred embodiment of the invention, it will be obvious that modifications may be made which come within the scope of the disclosure of the specification.

What is claimed is:

1. In a patients support table including a patients support arrangement; a pedestal supporting said patients support arrangement; at least two pressure medium drive motors for displacing said patients support arrangement relative to said pedestal in at least two directions; a pressure medium conduit for said motors; at least one controllable valve in said pressure medium conduit; and a control device receiving all of the control conduits of all said valves, said control device including manually actuatable control elements for said valves, said motors being compressed air motors, said motors for effecting the movement of said arrangement being located in an upper portion of the table, said upper table portion being removably connected with said pedestal; and coupling means being located between said upper table portion and said pedestal for releasing the compressed air flow between said pedestal and said upper table portion upon mounting of the latter on said pedestal and closing off the compressed air conduits of said pedestal upon removal of said table upper portion.

2. In a patients support table including a patients support arrangement; a pedestal supporting said patients support arrangement with a plurality of directions of movement of the patients support arrangement relative to said pedestal; pressure medium drive motor means for displacing said patients support arrangement relative to said pedestal in each direction of movement thereof relative to said pedestal; pressure medium conduit means for supplying actuating pressure medium flow to said pressure medium drive motor means to power the relative movement of the patients support arrangement in each direction of movement thereof; controllable valves in said pressure medium conduit means controllable for determining the actuating pressure medium flow to said pressure medium drive motor means to control the direction of movement of the patients support arrangement by said pressure medium drive motor means; exclusively nonelectrical control device means having nonelectrical control conduits controlling all of said controllable valves and including manually actuatable control elements for selective manual actuation to control said controllable valves via said nonelectrical control conduits in accordance with the selective manual actuation of said control elements; all of the powered movement of said patients support table relative to said pedestal being effected without the use of any liquid pressure medium and said pressure medium drive motor means being powered by compressed air actuating flow transmitted thereto via said pressure medium conduit means under the control of said controllable valves, and said pressure medium conduit means being arranged for coupling to a compressed air source, a valve for controlling actuating pressure medium flow to said drive motor means for selectively supplying driving air having two different pressures as the actuating pressure medium flow to said drive motor means; and a control element of said control device means for actuating said valve.

3. In a patients support table including a patients support arrangement; a pedestal supporting said patients support arrangement with a plurality of directions of movement of the patients support arrangement relative to said pedestal; pressure medium drive motor means for displacing said patients support arrangement relative to said pedestal in each direction of movement thereof relative to said pedestal; pressure medium conduit means for supplying actuating pressure medium flow to said pressure medium drive motor means to power the relative movement of the patients support arrangement in each direction of movement thereof; controllable valves in said pressure medium conduit means controllable for determining the actuating pressure medium flow to said pressure medium drive motor means to control the direction of movement of the patients support arrangement by said pressure medium drive motor means; exclusively nonelectrical control device means having nonelectrical control conduits controlling all of said controllable valves and including manually actuatable control elements for selective manual actuation to control said controllable valves via said nonelectrical control conduits in accordance with the selective manual actuation of said control elements; all of the powered movement of said patients support table relative to said pedestal being effected without the use of any liquid pressure medium and said pressure medium drive motor means being powered by compressed air actuating flow transmitted thereto via said pressure medium conduit means under the control of said controllable valves, and said pressure medium conduit means being arranged for coupling to a compressed air source, said motor means for effecting the movement of said arrangement being located in an upper portion of the table, said upper table portion being removably connected with said pedestal; and coupling means being located between said upper table portion and said pedestal for releasing the compressed air flow between said pedestal and said upper table portion upon mounting of the latter on said pedestal and closing off a compressed air conduit of said pedestal upon removal of said table upper portion.

* * * * *